US006886482B2

(12) United States Patent
Lothe et al.

(10) Patent No.: US 6,886,482 B2
(45) Date of Patent: May 3, 2005

(54) MANIFOLD DEVICE FOR PRESSURE VESSELS

(75) Inventors: Per Lothe, Førresfjorden (NO); Harald Årseth, Oslo (NO)

(73) Assignee: Knutsen OAS Shipping AS, Haugesund (NO)

( * ) Notice: Subject to any disclaimer, the term of this patent is extended or adjusted under 35 U.S.C. 154(b) by 0 days.

(21) Appl. No.: 10/467,494

(22) PCT Filed: Feb. 14, 2002

(86) PCT No.: PCT/NO02/00064

§ 371 (c)(1),
(2), (4) Date: Dec. 5, 2003

(87) PCT Pub. No.: WO02/066317

PCT Pub. Date: Aug. 29, 2002

(65) Prior Publication Data

US 2004/0074430 A1 Apr. 22, 2004

(30) Foreign Application Priority Data

Feb. 16, 2001 (NO) ..... 20010777

(51) Int. Cl.[7] ..... B63B 25/08

(52) U.S. Cl. ..... 114/74 R; 220/560.11

(58) Field of Search ..... 114/74 R, 74 T, 114/74 A; 220/560.11, 560.07

(56) References Cited

U.S. PATENT DOCUMENTS

| | | | | | |
|---|---|---|---|---|---|
| 2,537,085 | A | | 1/1951 | Phelps | |
| 3,886,885 | A | * | 6/1975 | Becker et al. | 114/74 A |
| 4,004,535 | A | * | 1/1977 | Oiern et al. | 114/74 A |
| 4,543,014 | A | * | 9/1985 | Brandi et al. | 405/207 |
| 6,003,460 | A | * | 12/1999 | Stenning et al. | 114/72 |
| 6,339,996 | B1 | * | 1/2002 | Campbell | 114/74 R |
| 6,584,781 | B2 | * | 7/2003 | Bishop et al. | 62/54.1 |

FOREIGN PATENT DOCUMENTS

| | | |
|---|---|---|
| EP | 0 333 951 | 9/1989 |

* cited by examiner

*Primary Examiner*—Andrew D. Wright
(74) *Attorney, Agent, or Firm*—Andrus, Sceales, Starke & Sawall, LLP

(57) ABSTRACT

A device by pressure vessels (2) for sea transport of petroleum fluids, where at least two pressure vessels (2) are connected to and communicate with a manifold (1).

7 Claims, 2 Drawing Sheets

MANIFOLD DEVICE FOR PRESSURE VESSELS

CROSS REFERENCE TO RELATED APPLICATION

Figure 1:
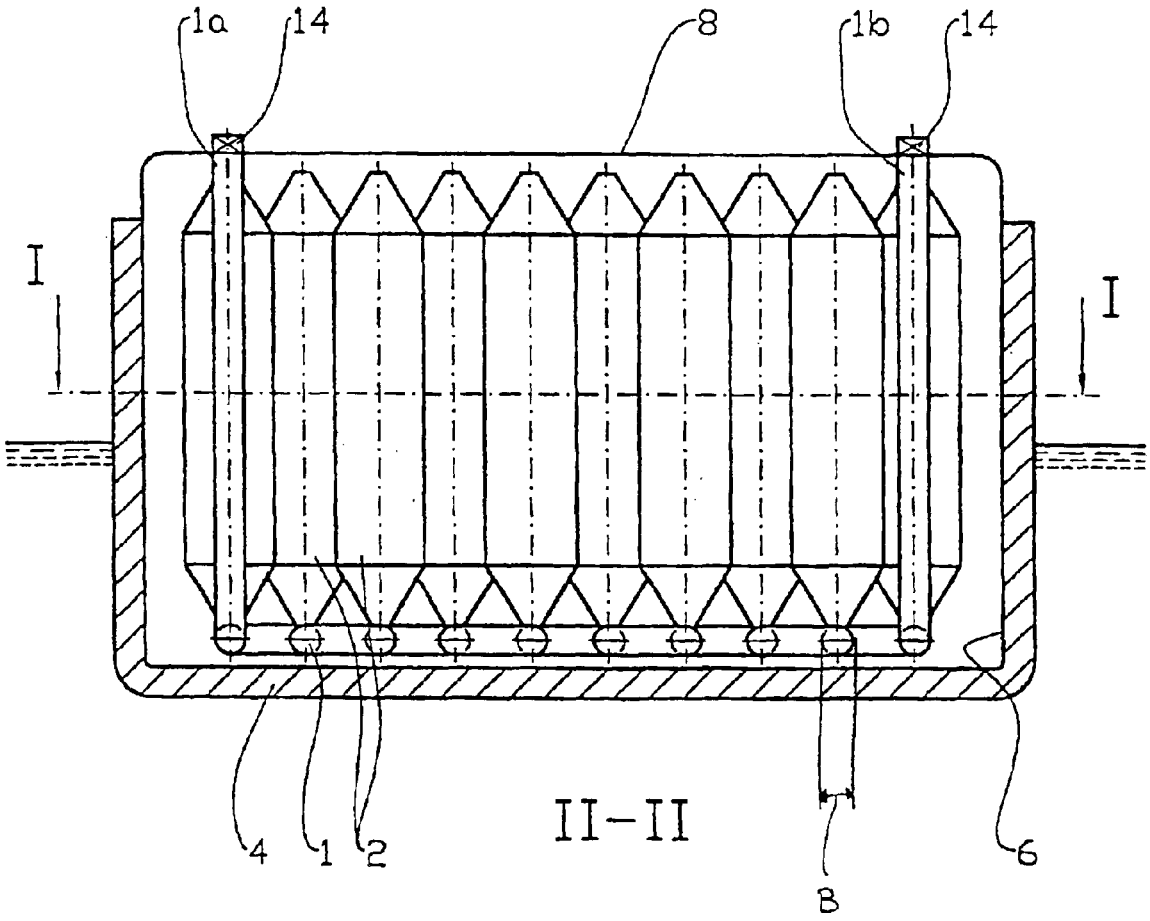

The present application is the U.S. national stage application of International Application PCT/NO02/00064, filed Feb. 14, 2002, which international application was published on Aug. 29, 2002 as International Publication WO 02/066317. The International Application claims priority of Norwegian Patent Application 20010777, filed Feb. 16, 2001.

This invention regards a piggable manifold, especially for use by pressure vessels of the type used for sea transport of well fluids in connection with petroleum production.

Sea transport of unprocessed well fluid containing gas is not economically feasible when using prior art. The gas fraction of the well stream must be compressed in order to achieve sufficient density during transport.

It is known for transport vessels to be equipped with cargo pressure vessels for transporting dry or wet gas. The method is termed Pressurised Natural Gas—PNG. According to such a method, the gas is compressed to an overpressure of a couple of hundred bar at the port of shipment, and then filled onto the pressure vessels located on the ship. The cooling is limited to simply and economically removing of the heat of compression from the gas, to give a transport temperature near the ambient temperature. Known designs of said PNG pressure vessels are not suited for transport of so-called "rich gas", which may contain fractions of e.g. propane, butane, naphtha and condensate. The reason for this is that a considerable segregation of the fluid and deposition at the bottom of the pressure vessels must be expected when transporting pressurised rich gas. As mentioned previously, pressure vessels according to prior art are not designed for the conditions specified, and will after a relatively short period of use be filled with the more viscous components of the rich gas, which can not be emptied.

The object of the invention is to remedy the disadvantages of prior art.

The object is achieved in accordance with the invention by the characteristics stated in the undermentioned description and in the appended claims.

According to the invention, pressure vessels of a type that is known per se for transport of pressurised gas are connected to a piggable manifold. In a preferred embodiment, the manifold is placed near the bottom of the cargo hold of a ship, and below the lower end portions of the pressure vessels. The manifold is connected so as to communicate with each pressure vessel in one or more rows of pressure vessels. The manifold is equipped with at least one lock for inserting a pig of a type that is known per se, which is designed to be displaced through a pipe e.g. by means of differential pressure, and which is equipped with scraper elements that fit the inside diameter of the pipe in a complementary manner.

During transport of e.g. rich gas, the heavier and more viscous components of the gas precipitate out. Said heavier gas components precipitate through a connecting port between the pressure vessel and the manifold, thus collecting mainly in the manifold.

After the gas has been unloaded from the pressure vessels, e.g. by means of conventional pumps, the remaining residue of sediment and precipitate may be removed by moving a pig through the manifold.

The pig may if so desired be arranged permanently in the manifold, whereby the unloading procedure can include more or less automatic use of the clean-out pig during the final phase of the unloading.

Figure 2:
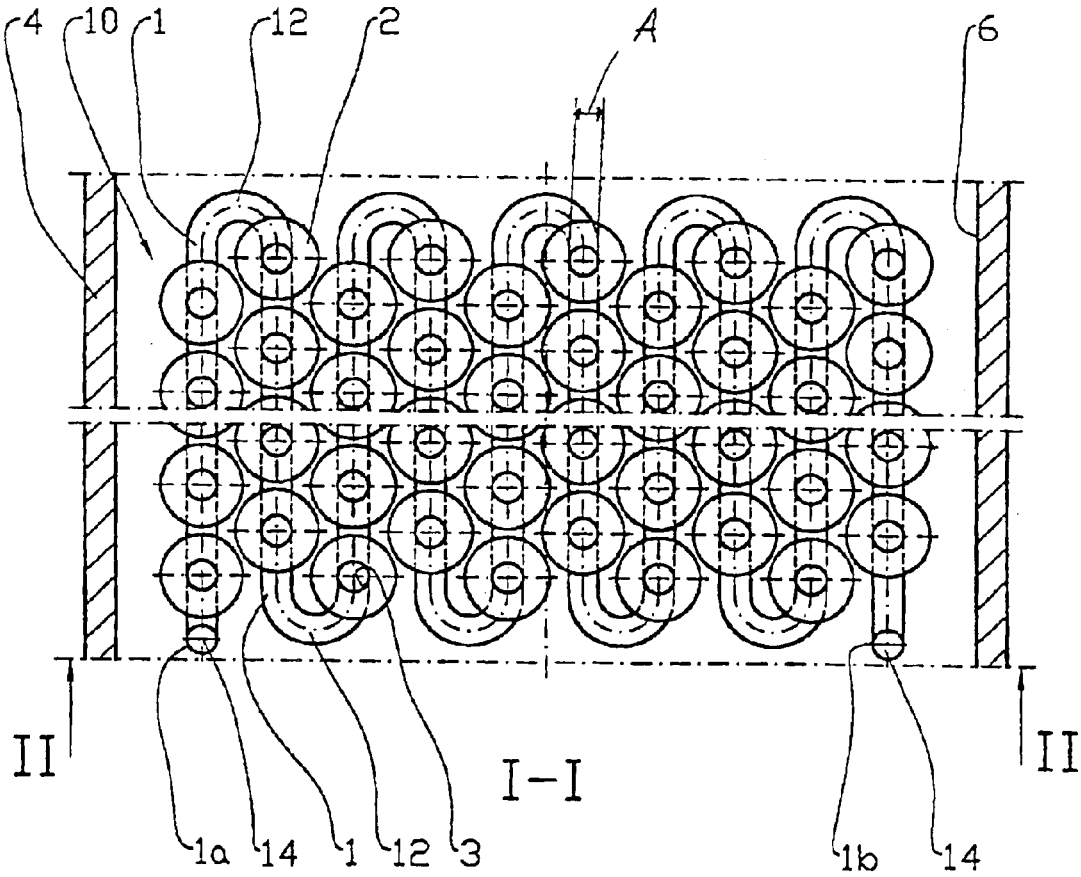

The following describes a non-limiting example of a preferred embodiment illustrated in the accompanying drawings, in which:

FIG. 1 schematically shows a section II—II in FIG. 2, of a ship's hold, where a manifold is positioned near the bottom of the cargo hold, which manifold communicates with a number of pressure vessels situated above; and FIG. 2 schematically shows a horizontal section I—I in FIG. 1.

In the drawings, reference number 1 denotes a manifold connected in a communicating manner via ports 3 to a number of pressure vessels 2 situated above. The manifold 1 and the pressure vessels 2 are located in the cargo hold 6 of a ship 4. The cargo hold 6 may be provided with hatches and/or a superstructure 8. The ports 3 between the pressure vessels 2 and the manifold 1 may advantageously have an area A larger than two thirds of the nominal cross sectional area B of the manifold 1.

The manifold 1 is arranged underneath and along rows 10 of pressure vessels 2 and may, as is apparent from FIG. 2, by use of bends 12 be constructed so as to communicate with other rows 10 of vessels. The manifold 1 is further provided with locks 14 at its end portions 1*a* and 1*b*, which locks are designed to lock a pig into and out of the manifold 1. Other connections required for loading and unloading, and structural connections, are not shown in the drawings.

When the precipitated and sedimented material is to be unloaded, as described in the general part of the description, a pig is locked into the manifold 1 via one of the locks 14. In accordance with common pigging practice, an overpressure is applied to the face of the pig facing away from the direction of travel. Thus the pig is displaced through the straight portions and the bends 12 of the manifold 1, which bends have a radius that is sufficient to allow the pig to pass, until it reaches the opposite end portion of the manifold, where it can be locked out of the manifold 1.

The device according to the invention allows pressurised transport of gas that is considerably less refined that that which is allowed by to prior art. In some cases, it will also render possible transport of unprocessed well fluid.

What is claimed is:

1. A method for removing a fraction that settles out of a rich gas petroleum product during marine transport, said method comprising the steps of:

providing a plurality of adjacent, vertically extending pressure vessels with an elongated piggable manifold connected to bottom portions of the pressure vessels;

filling the pressure vessels with a rich gas petroleum product;

allowing a rich gas fraction to settle into the bottom portions of the pressure vessels and to be received in the manifold; and moving a pig along the manifold for removing the rich gas fraction from the manifold.

2. The method of claim 1, wherein the manifold comprises at least one lock for locking the pig into and out of the manifold.

3. The method of claim 2, further comprising connecting ports disposed between the pressure vessels and the manifold.

4. The method of claim 3, wherein at least one connecting port has a cross sectional area equal to or greater than two thirds of the nominal cross sectional area of the manifold.

5. The method of claim 1, wherein the manifold is serpentine in form.

6. The method of claim 1, wherein connecting ports connect the pressure vessels and the manifold.

7. The method of claim 6, wherein at least one connecting port has a cross sectional area equal to or greater than two thirds of the nominal cross sectional area of the manifold.

* * * * *